US011040565B2

(12) United States Patent
Rauch et al.

(10) Patent No.: US 11,040,565 B2
(45) Date of Patent: Jun. 22, 2021

(54) METHOD FOR MANUFACTURING A SECURITY ELEMENT HAVING A LENS GRID IMAGE

(71) Applicant: GIESECKE+DEVRIENT CURRENCY TECHNOLOGY GMBH, Munich (DE)

(72) Inventors: Andreas Rauch, Ohlstadt (DE); Christian Fuhse, Otterfing (DE); Josef Schinabeck, Garmisch-Partenkirchen (DE); André Gregarek, Munich (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 45 days.

(21) Appl. No.: 16/469,036

(22) PCT Filed: Dec. 15, 2017

(86) PCT No.: PCT/EP2017/001429
§ 371 (c)(1),
(2) Date: Jun. 12, 2019

(87) PCT Pub. No.: WO2018/108318
PCT Pub. Date: Jun. 21, 2018

(65) Prior Publication Data

US 2019/0315150 A1 Oct. 17, 2019

(30) Foreign Application Priority Data

Dec. 15, 2016 (DE) ..... 10 2016 015 015.7

(51) Int. Cl.
*B42D 25/435* (2014.01)
*B42D 25/29* (2014.01)
(Continued)

(52) U.S. Cl.
CPC ..... *B42D 25/435* (2014.10); *B42D 25/29* (2014.10); *B42D 25/351* (2014.10); *B42D 25/355* (2014.10); *B42D 25/373* (2014.10)

(58) Field of Classification Search
CPC .... B42D 25/435; B42D 25/29; B42D 25/351; B42D 25/355; B42D 25/373
(Continued)

(56) References Cited

U.S. PATENT DOCUMENTS 4,765,656 A 8/1988 Becker et al.
9,697,456 B2 1/2017 Gregarek et al.
(Continued)

FOREIGN PATENT DOCUMENTS

DE 102013007484 A1 10/2014
DE 102014016009 A1 4/2016
(Continued)

OTHER PUBLICATIONS

International Search Report for PCT Application No. PCT/EP2017/001429, dated Mar. 5, 2018.
(Continued)

*Primary Examiner* — Justin V Lewis
(74) *Attorney, Agent, or Firm* — Workman Nydegger

(57) ABSTRACT

A method includes using a lenticular image having a lens grid composed of a plurality of microlenses and a metallic motif layer arranged spaced apart from the lens grid; the refractive effect of the microlenses defines a focal plane and the metallic motif layer being arranged substantially in the focal plane; a line width is chosen for the demetalized sub-regions to be produced in the metallic motif layer; a marking laser source having a laser wavelength λ is selected such that the resolving power D(λ) of the microlenses of the lenticular image at the selected laser wavelength λ substantially corresponds to the line width of the demetalized
(Continued)

sub-regions to be produced; and the metallic motif layer is impinged on through the microlenses with laser radiation of the marking laser source to produce demetalized sub-regions in the metallic motif layer.

21 Claims, 2 Drawing Sheets

(51) Int. Cl.
*B42D 25/351* (2014.01)
*B42D 25/355* (2014.01)
*B42D 25/373* (2014.01)

(58) Field of Classification Search
USPC .... 283/67, 70, 72, 74, 94, 98, 109, 110, 901
See application file for complete search history.

(56) References Cited

U.S. PATENT DOCUMENTS

2012/0091703 A1 4/2012 Maguire et al.
2012/0194916 A1* 8/2012 Cape ..... G07D 7/003 359/620
2013/0021339 A1 1/2013 Van Den Berg et al.
2013/0193679 A1* 8/2013 Fuhse ..... B42D 25/41 283/85
2016/0110638 A1 4/2016 Gregarek et al.

FOREIGN PATENT DOCUMENTS

EP 0219012 A2 4/1987
EP 3015279 A1 5/2016

OTHER PUBLICATIONS

German Search Report for DE Application No. 102016015015.7, dated Sep. 29, 2017.

* cited by examiner

METHOD FOR MANUFACTURING A SECURITY ELEMENT HAVING A LENS GRID IMAGE

BACKGROUND

The present invention relates to a method for manufacturing a security element having a lenticular image for depicting one or more target images that are visible only from predetermined viewing directions and whose motifs are formed by visually perceptible, contrasting metallic and demetalized sub-regions of a motif layer.

For protection, data carriers, such as value or identification documents, but also other valuable objects, such as branded articles, are often provided with security elements that permit the authenticity of the data carrier to be verified, and that simultaneously serve as protection against unauthorized reproduction.

Security elements having viewing-angle-dependent effects play a special role in safeguarding authenticity, as said elements cannot be reproduced even with the most modern copiers. Here, the security elements are furnished with optically variable elements that, from different viewing angles, convey to the viewer a different image impression and, depending on the viewing angle, display for example another color or brightness impression and/or another graphic motif.

It has long been known, for instance, to personalize identification cards, such as credit cards and identity cards, by means of laser engraving. In a personalization by laser engraving, the optical properties of the substrate material of the identification cards are irreversibly altered through suitable guidance of a laser beam in the form of a desired marking.

Document EP 0 219 012 A1 describes an identification card having a partial lens grid pattern through which desired pieces of information are inscribed in the card at different angles with a laser. Subsequently, when viewed, said pieces of information can also be perceived only at said angle, such that the different pieces of information appear when the card is tilted.

If a lenticular image includes a metallic motif layer, then the depicted motifs can be formed by local demetalizations in the metallic motif layer. Here, various possibilities are known for introducing a design into a metalization with a laser through demetalization. The demetalization can be done, for example, through direct inscription in that a laser beam is guided over the metallic motif layer by means of a suitable scanning unit, or also by a large-area laser impingement using a mask. In both cases, producing demetalized lines of a desired width in the motif layer poses a particular challenge.

If, for demetalization, the metallic motif layer is successively impinged on from various angles, and thus at different locations in the focal plane, with a finely focused laser beam until the sub-regions having the desired line width are each demetalized, then the scanning of the entire area of the lenticular image is normally very complex and laborious. Thus, to shorten the process duration, it was recommended to arrange the metallic motif layer outside the focal plane of the (micro-)lenses such that an expanded image of the incident laser radiation results in the plane of the motif layer upon laser demetalization. In this case, the demetalization can be performed significantly faster, but due to the defocusing, blurred tilt images having image changes that are no longer clearly defined are produced.

SUMMARY

Proceeding from this, it is the object of the present invention to specify a method of the kind mentioned above that avoids the disadvantages of the background art and that facilitates, especially at high production speed, a production of sharply delimited demetalized sub-regions of selectable line width in a lenticular image.

Said object is solved by the features of the independent claim. Developments of the present invention are the subject of the dependent claims.

According to the present invention, in a method of the kind cited above,

- a lenticular image having a lens grid composed of a plurality of microlenses and a metallic motif layer arranged spaced apart from the lens grid is provided,
- the refractive effect of the microlenses defining a focal plane and the metallic motif layer being arranged substantially in said focal plane,
- a line width is chosen for the demetalized sub-regions to be produced in the metallic motif layer,
- a marking laser source having a laser wavelength $\lambda$ is selected such that the resolving power $D(\lambda)$ of the microlenses of the lenticular image at the selected laser wavelength $\lambda$ substantially corresponds to the line width of the demetalized sub-regions to be produced, and
- the metallic motif layer is impinged on through the microlenses with laser radiation of the selected marking laser source to produce demetalized sub-regions in the metallic motif layer.

In one preferred method variant, the lenticular image is adapted for depicting $n \geq 2$ target images, and for the demetalized sub-regions to be produced, a line width is chosen that is between $0.6*d_{ML}/n$ and $1.4*d_{ML}/n$, preferably between $0.8*d_{ML}/n$ and $1.2*d_{ML}/n$, particularly preferably between $0.9*d_{ML}/n$ and $1.1*d_{ML}/n$, where $d_{ML}$ is the diameter of the microlenses. Here, the number n of target images to be depicted is especially 2, 3, 4 or 5.

Here, within the scope of this description, lenses whose size in at least one lateral direction lies below the resolution limit of the naked eye are referred to as microlenses. In principle, the microlenses can be developed to be spherical or aspherical, but currently the use of plano-convex cylindrical lenses is preferred such that, in the said method, a lenticular image having a lens grid composed of a plurality of plano-convex micro-cylindrical lenses is advantageously provided. With micro-cylindrical lenses, the term "diameter" always refers to the dimension perpendicular to the cylinder axis. The length of the micro-cylindrical lenses is arbitrary; for instance, when used in security threads, it can equal the total width of the thread and be several millimeters.

According to the present invention, the metallic motif layer of the lenticular image is arranged substantially in the focal plane of the microlenses, which especially means that the distance of the metallic motif layer from the focal plane is less than 25%, preferably less than 10% and particularly preferably less than 5% of the focal length of the microlenses.

The resolving power D of the microlenses of the lenticular image is advantageously determined by the Airy formula $D(\lambda)=2.44*\lambda*f/d_{ML}$, where f is the focal length of the microlenses, $\lambda$ the light wavelength and $d_{ML}$ the diameter of the microlenses. The marking laser source is then advantageously selected such that the resolving power D(λ) differs from the line width of the demetalized sub-regions to be produced by less than 15%, preferably by less than 10%.

Here, advantageously, an easily available laser source is used as the marking laser source, such as a Nd:YAG laser, a frequency-doubled Nd:YAG laser, a frequency-tripled Nd:YAG laser or an Er:glass laser. In principle, also other laser sources having other wavelengths can, of course be used, such as the diode laser, which is available for numerous wavelengths, as long as they are suitable only for demetalizing the metallic motif layer. If two or more different laser sources of differing wavelengths are used, then line widths of differing sizes can easily be realized in one security element.

In one advantageous development of the present invention, it is provided that, for fine control, the laser power of the marking laser source is adjusted to adapt the line width of the produced demetalized sub-regions to the chosen line width.

A lenticular image is advantageously provided whose lens grid comprises microlenses having a lens diameter between 5 μm and 20 μm and whose lens period is between 100% and 125% of the lens diameter.

The lens grid can adjoin air, but it can especially also be embedded in an embedding layer whose refractive index preferably differs from the refractive index of the microlenses by 0.2 or more.

Further exemplary embodiments and advantages of the present invention are explained below by reference to the drawings, in which a depiction to scale and proportion was dispensed with in order to improve their clarity.

BRIEF DESCRIPTION OF THE DRAWINGS

Shown are.

DETAILED DESCRIPTION OF VARIOUS EMBODIMENTS

Figure 1:
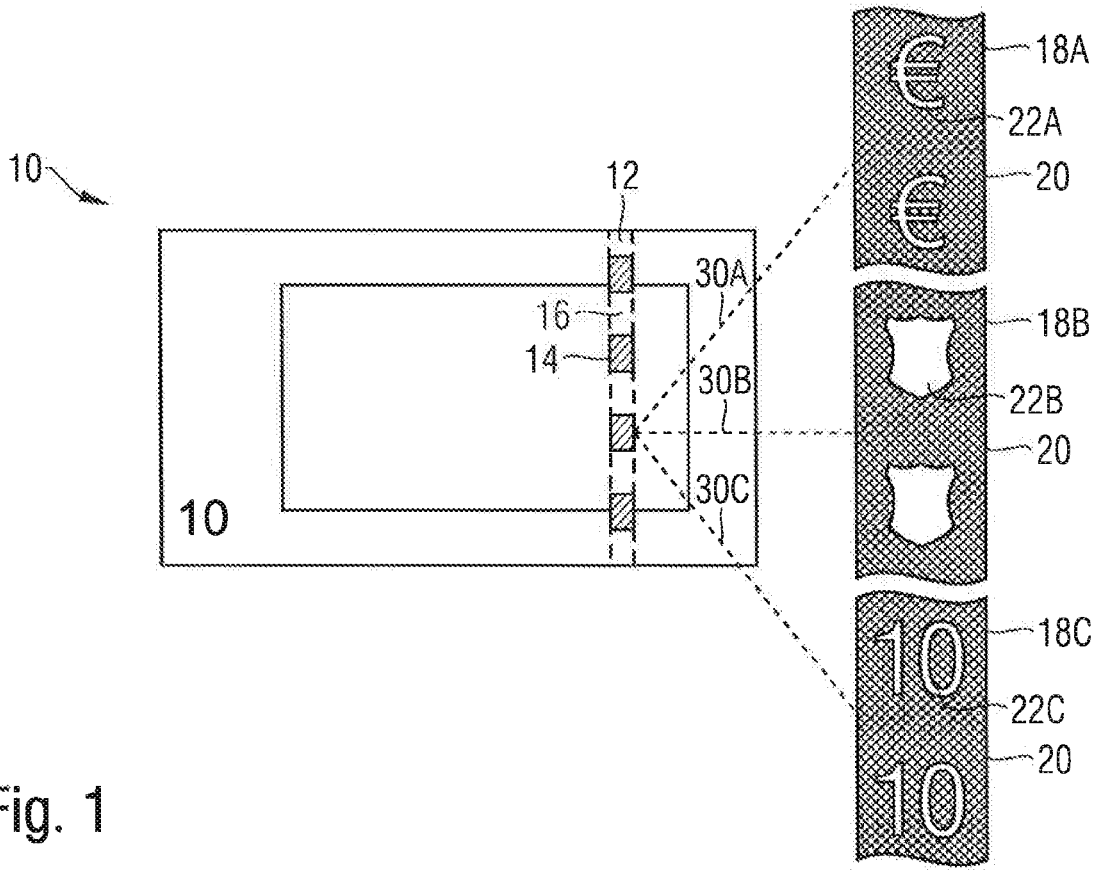
FIG. 1 a schematic diagram of a banknote having an inventive security element in the form of a window security thread that includes a tilt image having three different target images, FIG. 2 schematically, the structure of the window security thread in FIG. 1, in cross section, FIG. 3 a schematic drawing of a lenticular image to explain the principle used according to the present invention, and FIG. 4 schematically, the structure of a window security thread according to another exemplary embodiment of the present invention, in cross section.

The invention will now be explained using the example of security elements for banknotes and other value documents. For this, FIG. 1 shows a schematic diagram of a banknote 10 that is furnished with an inventive security element in the form of a window security thread 12. The window security thread 12 emerges at the surface of the banknote 10 in window regions 14, while it is embedded in the interior of the banknote 10 in the ridge regions 16 lying therebetween.

In the window regions 14, the security thread 12 displays a tilt image that, from three different viewing directions 30A, 30B, 30C, presents to the viewer in each case a different target image 18A, 18B or 18C. Here, the target images 18A-18C each display a motif that is formed from visually perceptible and contrasting metallic motif portions 20 and demetalized motif portions 22A, 22B, 22C.

Specifically, the window security thread 12 of the exemplary embodiment displays, when viewed obliquely 30A from above, a sequence of euro symbols 22A against a shiny metallic background 20, while when viewed perpendicularly 30B, a sequence of crest motifs 22B is visible against a shiny metallic background 20, and when viewed obliquely 30C from below, a sequence of numeral motifs 22C in the form of the denomination "10" is visible against a shiny metallic background 20. Upon tilting the banknote, the appearance of the window security thread 12 in the window regions 14 changes back and forth between the three target images 18A, 18B and 18C depending on the viewing direction.

Figure 2:
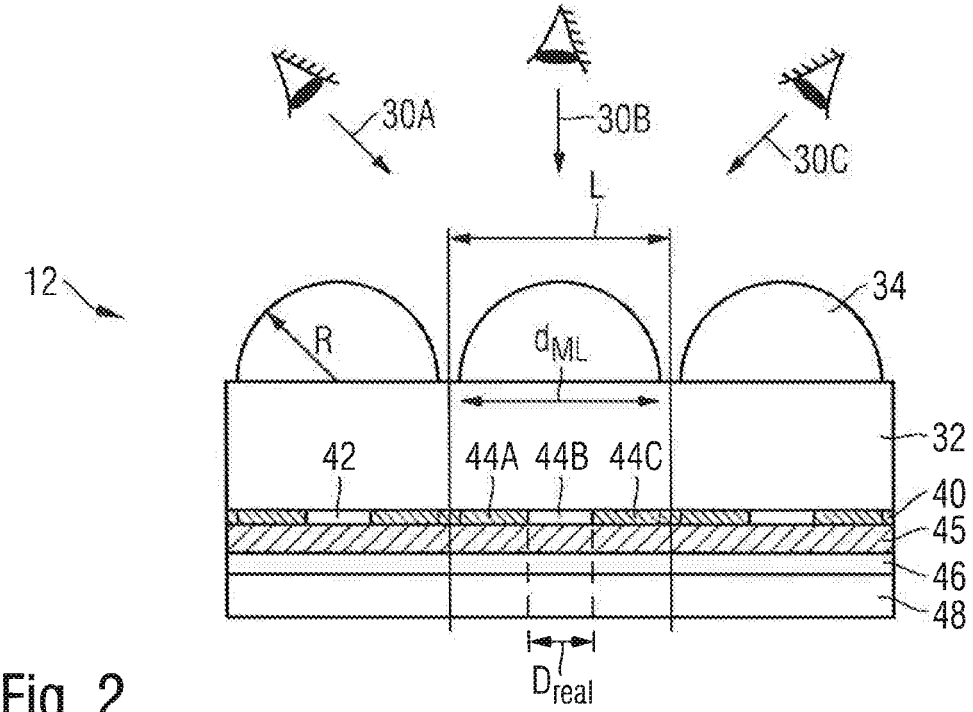

FIG. 2 shows, schematically, the structure of the window security thread 12 in FIG. 1 in cross section. The window security thread 12 comprises a carrier 32 in the form of a transparent plastic foil, for example a PET foil. The top of the carrier 32 is furnished with a lens grid in the form of a plurality of parallel plano-convex cylindrical lenses 34 that have a radius of curvature R=4 μm and a lens diameter $d_{ML}$=7 μm and are arranged in a lens grid having a lens period of L=8 μm. In the exemplary embodiment in FIG. 2, the lens grid adjoins air such that the cylindrical lenses having $n_{lens}$=1.5 and $n_{air}$=1 have a focal length of f=3R=12 μm.

On the bottom of the carrier 32 is formed, composed of aluminum, a motif layer 40 that comprises demetalized sub-regions 42 spaced apart in the grid of the cylindrical lenses 34. The carrier 32, the cylindrical lenses 34 and the motif layer 40 are coordinated with each other in such a way that the motif layer 40 is located in the focal plane of the cylindrical lenses 34.

For illustration, FIG. 2 shows a section of the lenticular image in which the motif layer 40 includes demetalized sub-regions 42 only in the regions 44B that are visible when viewed perpendicularly 30B. The regions 44A and 44C that are visible when viewed obliquely from above (viewing direction 30A) or obliquely from below (viewing direction 30C) have no demetalizations in the displayed section such that from these directions, in each case, the viewer views metal regions of the motif layer 40. Although the individual demetalized sub-regions 42 constitute narrow strips arranged in the grid of the cylindrical lenses, due to the focusing effect of the cylindrical lenses 34, they assemble to compose the desired sequence of motifs 18A-18C when viewed from the different viewing directions.

Due to the small dimensions of the cylindrical lenses 34, a large number of metallic or demetalized sub-regions interact in each case in reconstructing the motifs 18A-18C. For example, at a height of the demetalized motif portions 22A-22C of 2 mm and a lens period of the cylindrical lenses of L=8 μm, the demetalized sub-regions 42 that participate in the reconstruction of the "euro symbol," "crest" and "number string 10" motifs are distributed over an area of the motif layer 40 that is covered by 2 mm/8 μm=250 cylindrical lenses.

As likewise depicted in FIG. 2, the window security thread 12 typically includes further layers, such as a contiguous ink layer 45, which permits a coloring of the demetalized motif portions 22A-22C, an opaque white layer 46 and a heat seal coating layer 48. However, said layers or other functional layers are not significant for the present invention and are thus not described in greater detail.

In designing the motif image of a lenticular image for depicting three target images, it has proven to be particularly advantageous when the line width $D_{real}$ of the demetalized sub-regions 42 is substantially one-third of the diameter $d_{ML}$ of the microlenses 34. Analogously, the advantageous line width of the demetalized sub-regions in a lenticular image for depicting two target images is substantially half of the microlens diameter, and generally for a number n of target images to be depicted, substantially an n-th of the diameter $d_{ML}$ of the microlenses. In this way, on one hand, the available area of the motif layer is used to optimum advantage, and on the other hand, a clearly defined jumping around between the different target images is achieved when the lenticular image is tilted.

Conventionally, to achieve said advantageous line width, the motif layer 40 is, for example, scanned from different angles with a finely focused laser beam until sub-regions 42 of the desired width are demetalized, or, to increase the process speed, the motif layer is arranged outside the focal plane of the microlenses 34 such that, upon laser demetalization, an expanded and thus wider image of the incident laser radiation results in the plane of the motif layer. However, both variants have disadvantages as regards the process duration or the quality of the target images produced, as already explained above.

To remedy this, the solution according to the present invention uses the wavelength-dependent resolving power of the optical system formed by the microlenses to obtain, without defocusing, through a targeted selection of the wavelength of the laser radiation used for the demetalization, a desired line width.

Figure 3:
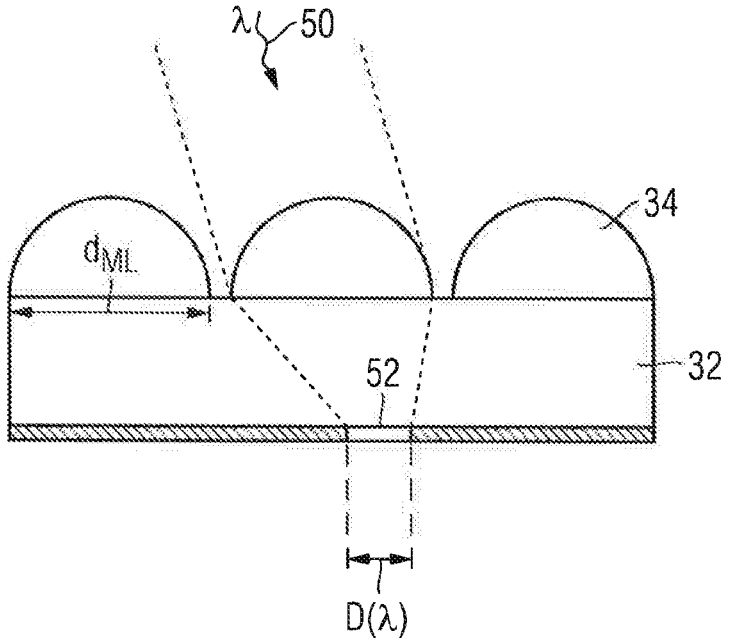

To explain the principle used in greater detail, with reference to FIG. 3, due to diffraction effects, even a parallel light beam 50 is not imaged to a point or, in the case of cylindrical lenses, to an infinitely narrow line by the microlenses 34, but produces an Airy disk or an elongated diffraction line 52 having a diameter $$D(\lambda)=2.44*\lambda*f/d_{ML} \quad (1)$$

where $\lambda$ represents the light wavelength, $d_{ML}$ the diameter of the microlenses and f the focal length of the microlenses. The variable D is also referred to as resolving power, since two points are just barely resolvable by an optical system when their Airy disks (or diffraction lines in the case of cylindrical lenses) overlap each other halfway. Thus, the diffraction-limited resolving power of the optical system of the microlenses 34 itself results, even in the case of optimum focusing of the incident laser radiation, in a certain laser-wavelength-dependent expansion of the focus region.

While the limited resolving power is traditionally viewed mostly as a limitation and as disadvantageous, the present invention deliberately uses the wavelength-dependent size of the diffraction spot to easily produce demetalizations of a desired line width in the focal plane and thus at maximum image sharpness.

Specifically, for example in the exemplary embodiment in FIG. 2, the initially still contiguous metallic motif layer 40 of the lenticular image is to be furnished with demetalized sub-regions to produce the target images 18A-18C. Since there are to be three image regions 44A-44C under each microlens 34, a target line width of $$D_{target}=d_{ML}/3=2.3\ \mu m$$

is chosen for the demetalized sub-regions 42. The equation (1) given above for the diameter D of the diffraction spot 52 can be solved for wavelength using the desired value of the line width $D_{target}$ for the diameter of the diffraction spot 52 in order to obtain an ideal target laser wavelength:

$$\lambda_{target}=0.41*D_{target}*d_{ML}/f \quad (2)$$

With a target line width of $D_{target}$=2.3 μm, the lens diameter $d_{ML}$=7 μm and the focal length of the microlenses f=12 μm, equation (2) results in a target laser wavelength of $\lambda_{target}$=550 nm.

Thus, as an easily available marking laser source, a frequency-doubled Nd:YAG laser having a wavelength of $\lambda$=532 nm is chosen for the demetalization. At this wavelength, according to equation (1), the diameter of the Airy disk is D=2.2 μm and thus, with a difference of only about 4%, corresponds substantially to the desired target line width $D_{target}$=2.3 μm.

When demetalizing, it can further be taken into account that, in practice, the exact value of D calculated according to equation (1) does not always result for the demetalized line width $D_{real}$, but rather that the actually achieved line width additionally depends slightly on the laser power used. Specifically, especially that region of the focused laser beam in which the laser intensity exceeds the threshold required to demetalize the metallic motif layer is decisive for the demetalization. Since the laser intensity at the edge of the diffraction spot drops very sharply, only a small variation of the actual line width $D_{real}$, which, however, in practice is suitable for fine control, can be achieved by increasing or decreasing the laser intensity.

In addition to the line width adjustment achieved through the wavelength-dependent resolving power, also the wavelength dependence of the refractive index n of the lens material can be used to achieve a further variation and especially an enlargement of the line width. In this way, with the refractive index n of the lens material, which generally varies depending on the wavelength, also the focal length f of the microlenses used varies depending on the wavelength of the incident radiation.

In the present invention, the demetalization occurs in such a way that, in a desired view of the security element in the visible spectral range, the metallic motif layer lies substantially in the focal plane of the microlenses. If the microlenses are impinged on, for example, with an IR laser (so for example a Nd:YAG laser having $\lambda$=1064 nm), then, depending on the material used for the microlenses, an additional widening of the lines can result in that the focal length at 1064 nm already differs significantly from the focal length in the visible spectral range. Thus, when the metallic motif layer is impinged on with laser radiation, similar conditions are present as in the known method described above, in which the motif layer is deliberately arranged outside the focal plane of the microlenses. Unlike in this known method, however, in the present invention, an arrangement lies "outside the focal plane" only at the wavelength used for demetalization.

After selecting the marking laser source and defining the laser intensity to be used for the demetalization (and, if appropriate, the refractive index of the lens material), the metallic motif layer 40 is impinged on through the microlenses 34 with laser radiation from three irradiation directions 30A, 30B, 30C in the form of the motifs 18A-18C to produce the desired demetalized sub-regions 42 in the metallic motif layer 40.

If, in the lenticular image in FIG. 2, demetalizations having different line widths are to be produced in the metallic motif layer 40, then, as easily available laser sources, for example also a Nd:YAG laser having $\lambda$=1064 nm and a focal width of D=4.4 μm, a frequency-tripled Nd:YAG laser having $\lambda$=355 nm and a focal width of D=1.5 μm, or also an Er:glass laser having $\lambda$=1540 nm and a focal width of D=6.4 μm can be used. By using two or more different laser sources of different wavelengths, different sized line widths can also easily be used in one security element.

Figure 4:
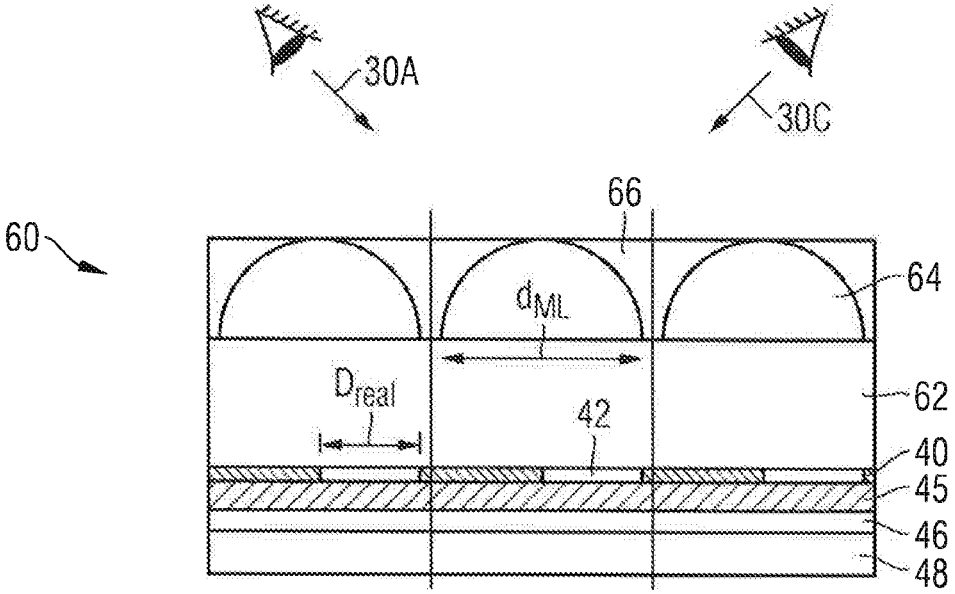

In a second concrete exemplary embodiment, the lenticular image 60 shown in FIG. 4 is to be furnished with two target images that become visible when viewed obliquely from above (viewing direction 30A) or obliquely from below (viewing direction 30C).

The top of the carrier 62 is furnished with a lens grid in the form of a plurality of parallel plano-convex cylindrical lenses 64 that have a radius of curvature R=4 μm and a lens diameter $d_{ML}$=7 μm and are arranged having a lens period of L=8 μm. In the exemplary embodiment, the lens material of the cylindrical lenses 64 has a refractive index $n_{lens}$=1.6, and the refractive index of the carrier foil 62 is $n_{foil}$=1.64. In addition, the cylindrical lenses 64 are embedded in an embedding layer 66 having a refractive index $n_{embedding}$=1.33.

On the bottom of the carrier are arranged, as in the exemplary embodiment in FIG. 2, a metallic motif layer 40, a contiguous ink layer 45, an opaque white layer 46 and a heat seal coating layer 48.

Since there is to be space for two image regions under each microlens, in the present exemplary embodiment, $$D_{target}=d_{ML}/2=3.5\ \mu m$$

is chosen as the target line width for the demetalized sub-regions 42 to be produced. To calculate the target laser wavelength with the aid of the equation (2) specified above, also the focal length of the microlenses 64 is needed, which in the present, embedded case results in $$f=n_{foil}/(n_{lens}-n_{embedding})*R=24.3\ \mu m.$$

With the aid of equation (2), from this data, a target laser wavelength of $\lambda_{target}$=410 nm results.

For the demetalization, in this case, as an easily available marking laser source, a frequency-tripled Nd:YAG laser having a wavelength of λ=355 nm is chosen. Since the diameter of the Airy disk at said wavelength has, according to equation (1), a somewhat smaller diameter (D=3.1 μm) than the target line width (11% difference), when demetalizing, the marking laser source is operated with high laser intensity to make the demetalized line width $D_{real}$ somewhat larger and to approach the target line width.

If, in the lenticular image in FIG. 4, demetalizations having other line widths are to be produced in the metallic motif layer, then also for example a Nd:YAG laser having λ=1064 nm and a focal width of D=9.0 μm, a frequency-doubled Nd:YAG laser having λ=532 nm and a focal width of D=4.7 μm, or an Er:glass laser having λ=1540 nm and a focal width of D=13.0 μm can be used.

The invention claimed is:

1. A method for manufacturing a security element having a lenticular image for depicting one or more target images that are visible only from predetermined viewing directions and whose motifs are formed by visually perceptible, contrasting metallic and demetalized sub-regions of a motif layer, and in the method a lenticular image having a lens grid composed of a plurality of microlenses and a metallic motif layer arranged spaced apart from the lens grid is provided, a refractive effect of the microlenses defining a focal plane and the metallic motif layer being arranged substantially in said focal plane, a line width is chosen for the demetalized sub-regions to be produced in the metallic motif layer, a marking laser source having a laser wavelength λ is selected such that a resolving power D(λ) of the microlenses of the lenticular image at the selected laser wavelength λ substantially corresponds to the line width of the demetalized sub-regions to be produced, and the metallic motif layer is impinged on through the microlenses with laser radiation of the selected marking laser source to produce demetalized sub-regions in the metallic motif layer.

2. The method according to claim 1, wherein the lenticular image is adapted for depicting n≥2 target images, and for the demetalized sub-regions to be produced, a line width is chosen that is between 0.6*dML/n and 1.4*dML/n, where dML is a diameter of the microlenses.

3. The method according to claim 1, wherein a lenticular image having a lens grid composed of a plurality of micro-cylindrical lenses is provided.

4. The method according to claim 1, wherein a lenticular image is provided whose metallic motif layer is arranged at a distance from the focal plane that is less than 25% of a focal length of the microlenses.

5. The method according to claim 1, wherein the resolving power D(λ) of the microlenses of the lenticular image is determined by a formula $$D(\lambda)=2.44*\lambda*f/dML,$$

where f is a focal length of the microlenses and dML is a diameter of the microlenses, and the marking laser source is adjusted in such a way that D(λ) differs from the line width of the demetalized sub-regions to be produced by less than 15%.

6. The method according to claim 1, wherein, as the marking laser source, a Nd:YAG laser, a frequency-doubled Nd:YAG laser, a frequency-tripled Nd:YAG laser or an Er:glass laser is used.

7. The method according to claim 1, wherein two or more different marking laser sources of different wavelengths are used.

8. The method according to claim 1, wherein, for fine control, a laser power of the marking laser source is adjusted to adapt the line width of the produced demetalized sub-regions to the chosen line width.

9. The method according to claim 1, wherein a lenticular image is provided whose lens grid comprises microlenses having a lens diameter between 5 μm and 20 μm and whose lens period is between 100% and 125% of the lens diameter.

10. The method according claim 1, wherein a lenticular image is provided whose lens grid is embedded in an embedding layer whose refractive index differs from the refractive index of the microlenses by 0.2 or more.

11. The method according to claim 1, wherein two different wavelengths are used.

12. The method according to claim 11, wherein the lenticular image is adapted for depicting n≥2 target images, and for the demetalized sub-regions to be produced, a line width is chosen that is between 0.6*dML/n and 1.4*dML/n, where dML is a diameter of the microlenses.

13. The method according to claim 11, wherein a lenticular image having a lens grid composed of a plurality of micro-cylindrical lenses is provided.

14. The method according to claim 11, wherein the resolving power D(λ) of the microlenses of the lenticular image is determined by a formula $$D(\lambda)=2.44*\lambda*f/dML,$$

where f is a focal length of the microlenses and dML is a diameter of the microlenses, and the marking laser source is adjusted in such a way that D(λ) differs from the line width of the demetalized sub-regions to be produced by less than 15%.

15. The method according to claim 11, wherein, as the marking laser source, a Nd:YAG laser, a frequency-doubled Nd:YAG laser, a frequency-tripled Nd:YAG laser or an Er:glass laser is used.

16. The method according to claim 11, wherein two or more different marking laser sources of different wavelengths are used.

17. The method according to claim 11, wherein, for fine control, a laser power of the marking laser source is adjusted to adapt the line width of the produced demetalized sub-regions to the chosen line width.

18. The method according to claim 11, wherein a lenticular image is provided whose lens grid comprises microlenses having a lens diameter between 5 μm and 20 μm and whose lens period is between 100% and 125% of the lens diameter.

19. The method according claim 11, wherein a lenticular image provided with the lens grid embedded in an embedding layer whose refractive index differs from the refractive index of the microlenses by 0.2 or more.

20. A method for manufacturing a security element having a lenticular image that depicts one or more target images that are visible only from predetermined viewing directions and whose motifs are formed by visually perceptible, contrasting metallic and demetalized sub-regions of a motif layer, the method comprising:

providing a lenticular image having a lens grid composed of a plurality of microlenses and a metallic motif layer arranged spaced apart from the lens grid, the lenticular image being provided such that a refractive effect of the microlenses defines a focal plane and the metallic motif layer is arranged substantially in said focal plane, choosing a line width for the demetalized sub-regions to be produced in the metallic motif layer, selecting a laser wavelength of a marking laser source such that a resolving power D(λ) of the microlenses of the lenticular image at the selected laser wavelength λ substantially corresponds to the line width of the demetalized sub-regions to be produced, and impinging on the metallic motif layer through the microlenses with laser radiation of the marking laser source at the selected laser wavelength to produce demetalized sub-regions in the metallic motif layer.

21. A security element having a lenticular image that depicts one or more target images that are visible only from predetermined viewing directions and whose motifs are formed by visually perceptible, contrasting metallic and demetalized sub-regions of a motif layer, the security element comprising:

a lenticular image having a lens grid composed of a plurality of microlenses and a metallic motif layer arranged spaced apart from the lens grid, a refractive effect of the microlenses defining a focal plane and the metallic motif layer being arranged substantially in said focal plane, wherein the demetalized sub-regions in the metallic motif layer have a line width, wherein the demetalized sub-regions in the metallic motif layer are produced by the metallic motif layer being impinged on through the microlenses with laser radiation of a marking laser source having a selected laser wavelength λ, and wherein the selected laser wavelength λ of the marking laser source is selected such that a resolving power D(λ) of the microlenses of the lenticular image at the selected laser wavelength λ substantially corresponds to the line width of the demetalized sub-regions.

* * * * *